United States Patent [19]

Seymour

[11] Patent Number: 4,840,704

[45] **Date of Patent: * Jun. 20, 1989**

[54] CONTROLLING CHARACTERISTICS OF A PULP MAT ON A PULP WASHING SURFACE

[76] Inventor: George W. Seymour, 2841 Parkwood Dr., Brunswick, Ga. 31520

[ * ] Notice: The portion of the term of this patent subsequent to Apr. 5, 2005 has been disclaimed.

[21] Appl. No.: 170,299

[22] Filed: Mar. 21, 1988

[51] Int. Cl.[4] ..... D21C 9/00

[52] U.S. Cl. ..... 162/49; 162/50; 162/60; 162/61; 162/DIG. 10; 8/156

[58] Field of Search ..... 162/49, 50, 60, 61, 162/DIG. 10; 68/258, 181 R; 8/156

[56] References Cited

U.S. PATENT DOCUMENTS

| | | | |
|---|---|---|---|
| 4,207,141 | 6/1980 | Seymour | 162/49 |
| 4,732,651 | 3/1988 | Lisnyansky et al. | 162/60 X |
| 4,735,684 | 4/1988 | Seymour | 162/60 X |

OTHER PUBLICATIONS

Perkins, J. K., "Brown Stock Washing Using Rotary Filters", Tappi Press, pp. 1-17, 19-23, 25-31, 33-37, 39-43, 45-51, 53-55.

Sande, W. E. et al., Tappi Journal, Mar. 1988, pp. 93-97.

*Primary Examiner*—David L. Lacey

*Assistant Examiner*—Thi Dang

[57] ABSTRACT

Pulp washing efficiency at any given dilution factor and production rate is maximized by controlling washing surface speed in response to determination of total mass of product stream in weight per unit area on the surface and simultaneously controlling the rate of dilution liquid introduction in response to sensing of feed level in the container feeding the surface, thereby to obtain a substantially constant level of pulp in the feed and in the pulp mat formed on the washing surface which is to undergo washing and a substantially constant weight of pulp mat (on a dry pulp basis) per unit area on the washing surface.

10 Claims, 1 Drawing Sheet

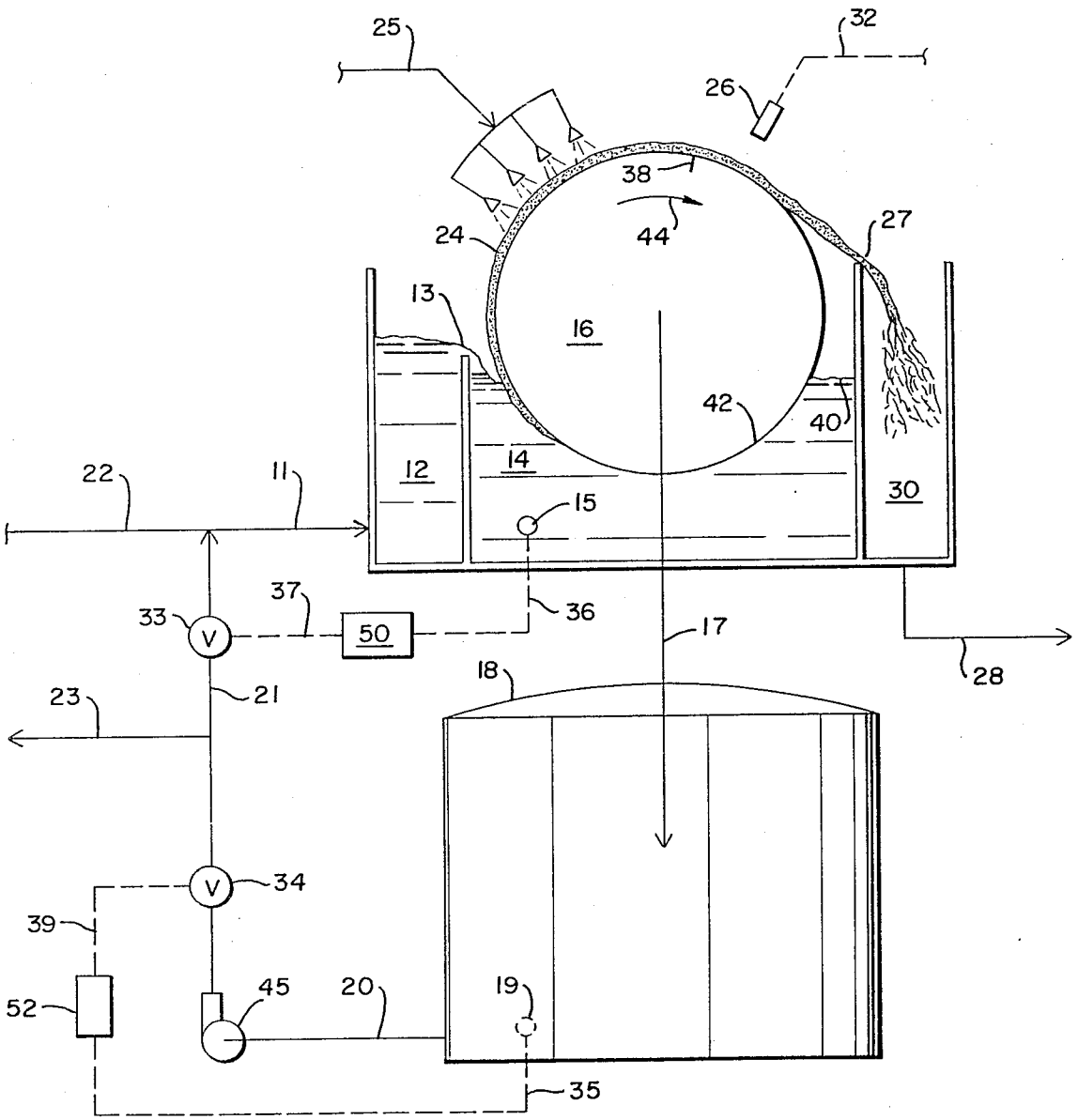
11
12
13
14
15
16
17
18
19
20
21
22
23
24
25
26
27
28
30
32
33
34
35
36
37
38
39
40
42
44
45
50
52
V
V

CONTROLLING CHARACTERISTICS OF A PULP MAT ON A PULP WASHING SURFACE

TECHNICAL FIELD

The present invention is directed at controlling to obtain more uniform operation in a cellulosic washing process.

More particularly, the present invention is directed to obtaining substantially constant consistency in the feed to the washing surface and in the pulp mat formed on said surface to be subjected to washing and to obtaining substantially constant weight of pulp mat (on a dry pulp basis) per unit area on the washing surface. In the context of a washer drum system, the present invention is directed to controlling drum speed and rate of dilution liquid stream flow to obtain substantially constant consistency in the washer vat and in the pulp mat formed on the drum and to obtain substantially constant weight of pulp mat (on a dry pulp basis) per unit area on the surface of the washer drum.

BACKGROUND OF THE INVENTION

No methods are known to be in use or to have been disclosed which are directed either to controlling consistency in the feed to the washing surface and in the pulp mat formed thereon or to controlling the weight of plup mat (on a dry basis) per unit area on the washing surface.

Methods as follows are used in drum washing systems to control drum speed and the rate of dilution liquid stream flow into the washer vat (vat dilution liquid flow).

In a first method, an operator uses his experience and information from inlet conditions into the first stage of the washing process, his observation of washer vat levels and his estimate of consistency in the washer vat, to manually adjust rotational speed of the washer drum and vat dilution liquid flow.

In a second method, washer drum rotation speed is controlled automatically in response to sensing of liquid level in the washer vat, and vat dilution liquid flow is adjusted manually by the operator based on his experience and information from the inlet conditions into the first stage of the washing process.

In a third method, the washer drum rotation speed is manually set by the operator based on his experience and information from the inlet conditions into the first stage of the washing process and vat dilution liquid flow is automatically controlled in response to sensing of liquid level in the washer vat to maintain a selected liquid level in the washer vat.

These three methods fail to control consistency in the washer vat or weight of pulp mat (on a dry pulp basis) on the washer drum. In these methods, normal process swings in tonnage rates entering the first stage increase or decrease the consistency in the liquid in the washer vat and the pulp weight per unit area on the washer drum and these increase and decreases cause inefficiencies in the washing process.

SUMMARY OF THE INVENTION

It has been discovered herein that pulp washing efficiency at any given dilution factor and production rate is maximized by controlling washing surface speed in response to determination of total mass of product stream in weight per unit area on said surface and simultaneously controlling rate of dilution liquid introduction in response to sensing of feed level in the container feeding said surface thereby to obtain a substantially constant percentage of pulp in the feed and a substantially constant weight of pulp mat (on a dry pulp basis) per unit area on the washing surface.

In particular, the method herein is directed to a pulp washing process wherein a cellulosic pulp slurry stream and a dilution liquid stream are continuously introduced to form a level of admixture of these streams comprising pulp and water in a container wherefrom a mat comprising contaminated pulp and water is continuously formed on a washing surface which is moved at a surface speed. Moreover, in said process wash water is directed at said mat on the washing surface and vacuum filtering is carried out to produce a product of washed pulp and water at a downstream location on said surface and a filtrate which is divided so that part of it is recirculated to provide said dilution liquid stream. The method herein, whereby a substantially constant percentage of pulp is obtained in said admixture and in the mat formed on the washing surface which is to undergo washing and a substantially constant weight of pulp mat (on a dry pulp basis) is obtained per unit area on the washing surface despite changes in production rate, comprises the steps of (a) measuring to determine the total mass of said product stream in weight per unit area on said surface and controlling said surface speed in response to said determination to obtain a selected value for said total mass, and (b) controlling the rate of said dilution liquid stream introduction in response to a level sensor in said container to obtain a selected level of said admixture in said container.

The term "product stream of washed pulp and water" is used herein to refer to the pulp mat comprising the washed pulp and water on the washing surface after a vacuum break and before discharge from the washing surface. The term "washed pulp" is used herein to refer to pulp which has been subjected to at least one washing step and includes pulp which is subjected to further washing thereafter.

Step (a) is readily carried out by measuring to determine total mass using backscattered nuclear radiation apparatus or by reliance on capacitance measuring apparatus to determine the capacitance across the product stream, or by reliance on product stream thickness, and automatically controlling washing surface speed in response to said determination, e.g., by controlling an adjustable motor or a transmission or other drive mechanism to obtain and maintain a selected weight of production stream per unit area at the location of measurement. Preferably, the measuring in step (a) is non-linear in respect to total mass determination and controlling to obtain a selected value correlated to the total mass eliminates error which would be attributable to said non-linearity.

Step (b) is readily carried out by automatically controlling a valve on a dilution liquid stream introduction line in response to sensing of feed admixture level in said container to maintain selected level in said container.

Step (b) is necessary because when the washing surface speed is changed in step (a), the hydraulic capacity of the washing surface and vacuum filter is changed. This step (b) compensates for increase or decrease in feed consistency due to step (a).

The subject method herein not only maximizes washing efficiency as indicated hereinbefore but also allows an increase in production rates for systems ordinarily limited by washing efficiency or pulp washer performance.

BRIEF DESCRIPTION OF THE DRAWING

The foregoing objects, features, and advantages of the invention will be more fully understood upon a consideration of the following detailed description of a preferred embodiment of the invention, together with the accompanying drawing.

The single FIGURE of the drawing is a flow schematic of one drum type washer in a multistage countercurrent pulp washing process.

DETAILED DESCRIPTION

Before proceeding to the description of the drawing, it is noted that the drawing is directed to one stage in a process for countercurrent washing of brown stock normally relying on two or three vacuum filter washer drums in series. Such a system is depicted in FIG. 1 of Seymour U.S. Pat. No. 4,207,141 and is described therein at column 4, lines 65 to column 6, line 2 and this depiction and description is incorporated herein by reference.

However, while the drawing is directed to a particular process as described, the method herein is also advantageously used in systems relying on a continuous screen wire (apertured) belt or the like as in a Fourdrinier type washer where the washing surface is gravity fed from above by a headbox and the washing surface constitutes a plurality of stages. Moreover, the method herein is applicable for use in a washing system employing at least one vacuum filter drum with a plurality of washing stages in a single drum. The method herein is also applicable to pulp bleaching systems, and waste treatment drum filters to increase the efficiency of these systems.

We turn now to the embodiment of the drawing. With continuing reference to the drawing, pulp and liquid brown stock from pulp digesters (not shown) containing black liquid contaminant to be removed by washing is routed via a transfer line 22 and is admixed with vat dilution liquid entering via line 21 to form an admixture of contaminated pulp and water and the admixture is routed by a feed line 11 into a headbox 12 of a drum washer system. Said admixture builds up in headbox 12 and overflows as indicated by reference numeral 13 into washer vat 14 to form a body of feed admixture therein whose upper surface is denoted by reference numeral 40. A vacuum filter drum 16 having an apertured wire surface 42 has its lower portion protruding into the body of feed admixture in washer vat 14 and rotates in the direction shown by arrow 44 and application of vacuum from the interior of drum 16 through apertures in wire surface 42 causes a mat of pulp 24 to form on surface 42 that contains 80–90% liquid and 10–20% pulp and causes some of the liquid in said body of feed admixture to enter the interior of drum 16. A wash water spray from a wash sprayer 25 directs shower liquid onto the pulp mat 24 passing thereunder and displaces the more contaminated liquid that was retained in the mat 24 as formed on surface 42. A more pure mat in the form of a product stream 27 is fed into a discharge means 30, e.g., in the form of a screw conveyor, and is discharged as indicated by the arrow designated by reference numeral 28 to a next stage of washing or a next operation. Liquid displaced from mat 24 by the shower spray plus the volume of shower liquid in excess of the amount required to constitute the liquid in product stream 27 is drawn by the vacuum of drum 16 through apertures in wire 42 into the interior of drum 16. The liquid entering the interior of drum 16 which is designated filtrate or filtrate liquid is discharged therefrom via downleg 17 into filtrate tank 18 and forms a body of filtrate liquid (not shown) therein. An outlet line 20 from tank 18 is equipped with a pump 45 and a valve 34 whereby the filtrate is removed from tank 18. Line 20 branches into a line 23 which routes part of the filtrate in line 20 to the previous washing stage shower (wash sprayer) or another operation and the line 21 which contains a valve 33 and as previously indicated recirculates part of the filtrate as a dilution liquid stream which is admixed with the brown stock feed entering via line 22.

The rate of shower liquid (wash water) input is determined by means not shown, i.e., by the method of Seymour U.S. Pat. No. 4,207,141 or other wash water input control system.

The filtrate tank 18 contains a level sensor 19 (e.g., of the pressure sensing type) which senses the level of filtrate in tank 18 and sends a signal via a signal line 35 to a controller 52 which is set with a set point correlated to a selected level and signals valve 34 via a signal line 39 to actuate valve 34 to a more open or closed position to automatically adjust the flow through line 20 to maintain the selected level in tank 18. This filtrate tank level control system is of a conventional type.

A measuring means schematically designated by reference numeral 26 is located to operate on the pulp mat on wire 42 downstream of a vacuum break 38 and before discharge from the screen surface 42, i.e., to operate on the product stream (which is composed of cleaner pulp than in the feed and water), to enable determination of total mass in said product stream per unit area of surface 42 at the location where measuring is carried out.

The measuring means 26 is preferably a backscattered nuclear radiation gauge that directly measures total mass of product stream in weight per unit on the wire 42. Suitable apparatus is readily available commercially from NDC Systems of Monrovia, Calif. or the Ohmart Corporation of Cincinnati, Ohio.

The measuring means 26 can also be apparatus for measuring capacitance across the pulp mat thereunder which is sensitive primarily to the water in the pulp mat product which as indicated above is 80–90% water. With this type of system capacitance measurement is converted to a weight of liquid per unit area by multiplication by a scaling factor and the weight of liquid per unit area is converted to weight of total product per unit area by utilizing an assigned consistency (e.g., determined by measuring the same in the product stream or estimated). Capacitance measurements to determine weight of liquid per unit area in a pulp mat are disclosed in Seymour U.S. Pat. No. 4,207,141.

The measuring means 26 can also be apparatus for measuring the thickness of the pulp mat thereunder, i.e., the level of the top surface of the mat above wire 42. Such apparatus can rely on mechanical measurements carried out, for example, utilizing a mechanical lever arm attached to a ski shaped means which rides on the top surface of the pulp mat. Such apparatus can also instead rely on sound or electromagnetic waves where such waves are projected from a generator at the pulp mat and measurement of reflected waves is correlated to thickness. When thickness measuring means is utilized, total mass in weight per unit area at the location measured is readily determined by multiplying the measured thickness by a specific gravity for the mat which is derived, for example, from measurements or estimation.

The measuring means 26 includes means to send a signal correlated to total mass of the pulp mat product stream in weight per unit area of wire 42 via a signal line 32 to a controller (not shown) which automatically controls means (not shown) to vary the speed of the rotation of drum 16, e.g., an adjustable motor. The controller set point is set at a selected total mass so that it causes the speed of rotation of drum 16 to increase when the determined total mass is above the selected value and so that it causes the speed of rotation of drum 16 to decrease when the determined total mass is below the selected value thereby to automatically control the total mass per unit area of pulp mat on wire 42 in the measured area to obtain and maintain the selected total mass value.

While various measuring means 26 are non-linear in respect to measurement of total mass per unit area on wire 42, controlling to obtain a selected valve correlated to the total mass eliminates error which would be attributed to said non-linearity.

The washer vat 14 contains a level sensor 15, for example of the pressure sensing type, for sensing the level of diluted pulp slurry in vat 14. The level sensor 15 sends a signal correlated to the level sensed via a signal line 36 to a controller 50 which is set with a set point correlated to a selected level and signals valve 33 via a signal line 37 to automatically control valve 33 to control the dilution water input via line 21 to control the level of diluted pulp slurry in vat 14 to the selected value set whereby a desired consistency of, for example $1\frac{1}{4}\%$ to $1\frac{1}{2}\%$, may be obtained and maintained in the diluted pulp slurry in vat 14.

The method as described in conjunction with the figure of the drawing provides a substantially constant consistency in vat 14 and mat 24 and a substantially constant weight of pulp mat (on a dry pulp basis) per unit area on the wire 42.

Variations will be evident to those skilled in the art. Therefore, the scope of the invention is intended to be defined by the claims.

What is claimed is:

1. In a pulp washing process wherein a cellulosic pulp slurry stream and a dilution liquid stream are continuously introduced to form a level of admixture of these streams comprising pulp and water in a container wherefrom a mat comprising pulp and water continuously forms on a washing surface which is moved at a surface speed and wherein wash water is directed at said mat on said washing surface and vacuum filtering is carried out to produce a product stream of washed pulp and water at a downstream location on said surface and a filtrate which is divided so that part of it is recirculated to provide said dilution liquid stream, the improvement comprising the steps of:

(a) determining the total mass of said product stream in weight per unit area on said surface and adjusting said surface speed in response to said determination to reach a selected value for said total mass, (b) adjusting the rate of said dilution liquid stream introduction in response to a level sensor in said container to reach a selected level of said admixture in said container.

2. The process of claim 1, wherein determining in step (a) is carried out utilizing a backscattered nuclear radiation apparatus.

3. The process of claim 1, wherein determining in step (a) comprises measuring capacitance across said product stream using a capacitance device where measurement is converted to weight of liquid per unit area by use of a scaling factor and the weight of liquid per unit area is converted to total mass of product stream per unit area utilizing an assigned consistency.

4. The process of claim 1, wherein measuring in step (a) comprises determining the thickness of said product stream and converting said thickness to mass per unit area using an assigned specific gravity.

5. The process of claim 1 wherein the cellulosic pulp slurry stream is brown stock.

6. The process of claim 1 wherein the cellulosic pulp slurry is effluent from a bleaching process.

7. The process of claim 1 wherein said method is carried out in at least one stage of a countercurrent pulp washing process.

8. The process of claim 1 wherein said moving surface moves the mat thereon through a plurality of stages of washing.

9. The process of claim 1 wherein said moving surface is a continuous apertured belt.

10. The process of claim 1, wherein the determination in step (a) involves a measurement which is non-linear with respect to the total mass of said product stream on said surface.

* * * * *

UNITED STATES PATENT AND TRADEMARK OFFICE

CERTIFICATE OF CORRECTION

PATENT NO. : 4,840,704

DATED : June 20, 1989

INVENTOR(S) : George W. Seymour

It is certified that error appears in the above-identified patent and that said Letters Patent is hereby corrected as shown below:

Claim 4, line 1 (column 6, line 29), change "measuring" to

- - determining - -

Claim 4, line 2 (column 6, line 30), change "determining" to

- - measuring - -

Signed and Sealed this

Sixth Day of February, 1990

*Attest:*

JEFFREY M. SAMUELS

*Attesting Officer*

*Acting Commissioner of Patents and Trademarks*